United States Patent [19]

Pruitt

[11] Patent Number: 4,948,186

[45] Date of Patent: Aug. 14, 1990

[54] LIFTING MEANS FOR A PAPER ROLL

[75] Inventor: Robert C. Pruitt, Newberry, S.C.

[73] Assignee: Carolina Slings Co., Inc., Hardeeville, S.C.

[21] Appl. No.: 384,569

[22] Filed: Jul. 25, 1989

Related U.S. Application Data

[63] Continuation-in-part of Ser. No. 340,447, Apr. 19, 1989.

[51] Int. Cl.[5] ..... B65H 49/00; B66C 1/16

[52] U.S. Cl. ..... 294/67.1; 294/1.1

[58] Field of Search ..... 294/1.1, 67.1, 67.3, 294/67.4, 74, 82.1, 82.11, 89, 93, 94, 137, 149, 151–153, 156, 158; 24/115 R, 115 K; 206/303, 386, 595; 242/68, 68.3, 85, 85.1, 129, 129.5, 136; 414/684, 910, 911

[56] References Cited

U.S. PATENT DOCUMENTS

| | | | |
|---|---|---|---|
| 415,391 | 11/1889 | Matteson | 294/67.1 |
| 572,468 | 12/1896 | Brown et al. | 294/67.4 |
| 1,510,564 | 10/1924 | Stockfleth et al. | 294/67.1 X |
| 2,848,267 | 8/1958 | Wroblewski | 294/1.1 |
| 3,021,010 | 2/1962 | McMasters | 294/67.1 X |
| 3,301,451 | 1/1967 | Halverson | 294/158 |
| 3,306,651 | 2/1967 | Brown | 294/67.3 |
| 3,626,508 | 12/1971 | Sharrow | 294/89 |
| 3,778,002 | 12/1973 | Alleweireldt | 294/67.1 X |
| 4,133,435 | 1/1979 | Hosbein | 294/67.1 X |
| 4,345,788 | 8/1982 | Newton | 294/67.1 X |
| 4,796,939 | 1/1989 | Symonds et al. | 294/67.1 |

FOREIGN PATENT DOCUMENTS

| | | | |
|---|---|---|---|
| 1139944 | 11/1962 | Fed. Rep. of Germany | 294/158 |
| 3410445 | 8/1985 | Fed. Rep. of Germany | 294/1.1 |
| 81463 | 3/1953 | Norway | 294/67.4 |
| 562529 | 7/1944 | United Kingdom | 294/158 |
| 1431042 | 4/1976 | United Kingdom | 294/67.4 |
| 1462855 | 1/1977 | United Kingdom | 294/67.4 |

*Primary Examiner*—Johnny D. Cherry

*Attorney, Agent, or Firm*—Hurt, Richardson, Garner, Todd & Cadenhead

[57] ABSTRACT

A lifting device is employed to support a roll of paper wrapped around a core, the lifting device including a flat support plate having an open central portion. A pair of spaced opposed upstanding loops or links are welded by one side to the plate and the loops. Opposed rods welded to the plate guide the core portion over the loops and rods. A continuous woven fabric web or strap, formed with overlapping end portions, is received through the two loops so that the strap can extend up through the core and protrude out of the other end of the core. The rods guide the core into an appropriate seated position on the plate.

14 Claims, 1 Drawing Sheet

LIFTING MEANS FOR A PAPER ROLL

CROSS REFERENCE TO RELATED APPLICATIONS

This is a continuation-in-part of my co-pending application, Ser. No. 340,447, filed Apr. 19, 1989.

FIELD OF THE INVENTION

This invention relates to a lifting device for objects having a hollow central core and material disposed around the core such as a roll of paper received on the hollow core.

BACKGROUND OF THE INVENTION

In the past, numerous lifting devices have been devised for providing a sling by which a roll of paper mounted on a core can be transferred from place to place by a cargo hook. U.S. Pat. No. 4,345,788 issued Aug. 24, 1982 to Newton discloses a typical lifting device of the prior art. Such a structure is quite expensive and is not readily installed or removed from the roll of paper. U.S. Pat. No. 4,796,939 issued Jan. 10, 1989 to Symonds, et al, discloses other types of lifting devices for rolls of paper on a core. The embodiments in the patent to Symonds are quite expensive, will permit the sling to wear when the sling is dragged across a concrete surface and are relatively complicated to manufacture. The structure of the present device is very inexpensive to manufacture and yet is quite easy to assemble and easy to install in a core for transporting paper.

SUMMARY OF THE INVENTION

Briefly described, the present invention comprises a lifting device which has a flat metal supporting plate which is preferably square or rectangular in shape and has a flat top and bottom. Because this lifting device is primarily for use with large rolls of paper, the central portion of the plate is stamped out to provide a rectangular or square opening whose sides are bisected by the diagonals of the plate. Mounted inwardly of the opposed corners of the plate are a pair of upstanding relatively small rods whose bases are welded in place on the upper surface of the plate and whose bodies are inclined slightly inwardly toward each other. The distance between the outsides of the opposed upstanding guide rods is approximately equal to the inside diameter of the core so that the rods will guide the core into a centered position.

Arranged on the other diagonal of the plate and respectively approximately 90° from the two upstanding guide rods are a pair of opposed metal sling receiving loops which are formed from individual links of a chain. The links of the chain are mounted adjacent to the other opposed corners of the plate and are spaced inwardly from these corners sufficiently that the links will be received snugly in one end of the core when the core is received over the opposed rods, as well over the opposed links. The ends of the links form arresting elements which will preclude appreciable lateral movement of the core, once the end of the core has been centered on the plate. In like fashion, the proximal ends of the upstanding guide rods arrest lateral movement at 90° to the above mentioned lateral movement of the core with respect to the plate once the core is properly mounted on the plate.

The loops are sufficiently aligned that a portion of a flexible fabric strap or sling can pass, parallel to the plate and in a diagonal path across the plate and, thence, extends upwardly through the core to protrude from the upper end of the core. The strap is a continuous member and has a sufficient bite portion, above the core and the paper, that it can be engaged by a hook or by a rod mounted on a forklift so that the roll of paper can be readily transported from place to place.

Accordingly, it is an object of the present invention to provide a lifting device for a paper roll which device is inexpensive to manufacture, durable in structure and efficient in operation.

Another object of the present invention is to provide a lifting device for a paper roll in which the sling thereof can be easily attached and easily replaced.

Another object of the present invention is to provide a lifting device for a paper roll in which the links or loops which receive the straps serve a double function of centering the core on the plate and also retaining the strap.

Another object of the present invention is to provide a lifting device for a paper roll, the lifting device being easy to install and remove on the end of the core of the paper roll.

Another object of the present invention is to provide a lifting device for a paper roll which device can be easily manufactured using conventional tools and available parts.

Another object of the present invention is to provide a lifting device for a paper roll which can be readily urged onto the end portion of a core of the paper roll and will evenly support a substantial portion of the edge of the paper.

Other objects, features and advantages of the present invention will become apparent from the following description when taken in conjunction with the accompanying drawing wherein like characters of reference designate corresponding parts throughout the several views.

DETAILED DESCRIPTION

Figure 1:
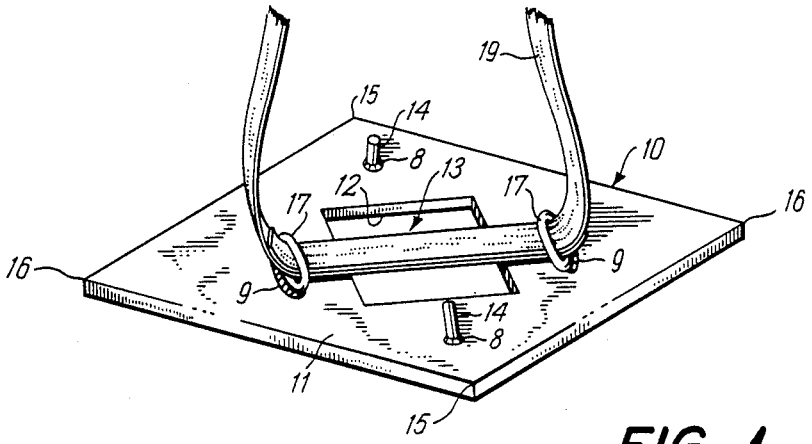
FIG. 1 is an exploded perspective view of a lifting device constructed in accordance with the present invention and receiving a conventional roll of paper thereon.
Figure 2:
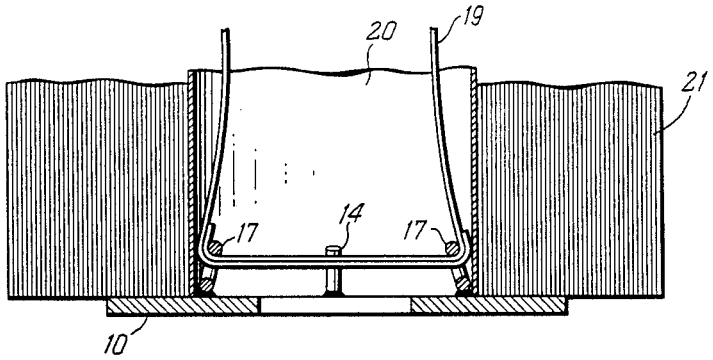
FIG. 2 is fragmentary vertical sectional view of the lifting device and a roll of paper on a core, the lifting device being that shown in FIG. 1.
Figure 3:
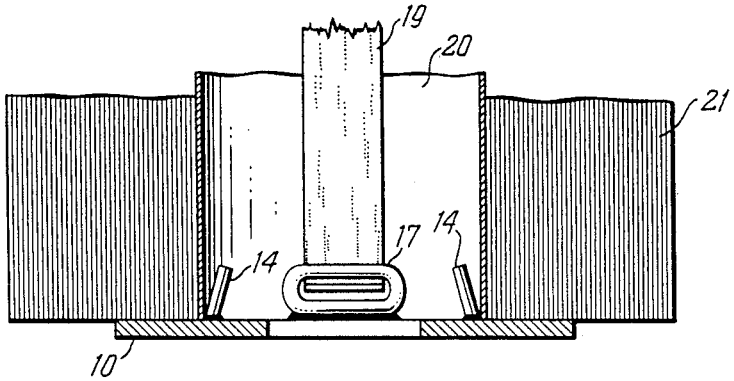
FIG. 3 is an enlarged vertical sectional view of a detail of the device shown in FIG. 1.

Referring now in detail to the embodiment chosen for the purpose of illustrating the present invention, numeral 10 denotes generally a flat rectangular, preferably square supporting plate having an upper surface 11 and a lower surface 12. The plate 10 is planar or flat, being approximately 15 inches long and 15 inches wide. The thickness of the plate is about 5/16 inch of cold rolled steel.

The central portion of the plate 10 is removed to provide a square opening, denoted by numeral 13. This opening is rectangular or square and is preferably about 6 inches long and 6 inches wide. Thus, the material removed from the hole 13 will serve as a plate for a smaller lifting device.

Mounted on the upper surface 11 of plate 10 are a pair of opposed upstanding cylindrical guide pins or rods 14, whose bases or proximal ends are welded at welds 8 to the upper surface 11 along the diagonal between the opposite corners 15 of the plate 10, outwardly of the opening 13 and inwardly of such corners 15. These rods 14 form guide means which protrude upwardly from surface 11 and converge slightly toward each other to terminate a short distance upwardly from plate 10. The height of the rods 14 is just sufficient so that these rods will function to center the core 20 on the plate 10. The space between the outer portions of the proximal ends of rods 14 are about equal to or slightly less than the diameter of the core 20 of a roll 21 of paper so that the core 20 is snugly received by the rods 14 and centered on the plate 10 when it is fully seated.

On the diagonal of the other opposite corners 16 of the plate 10 are respectively a pair of opposed identical chain links or loops of metal 17, the lower bars or flights of which are welded by welds 9 to the upper surface 11 of plate 10. The lower flights or bars of loops 17 are respectively bisected by and extend perpendicular to the diagonal of the plate 10. The loops 17 are inclined slightly inwardly so that the web, strap or sling of fabric, denoted by numeral 19, can pass through the openings in the aligned loops 17 and thence upwardly through the core 20 of the roll of paper 21, the sling 19 being a continuous member and of a length to protrude out of the upper end of the core, so that the protruding bite can be engaged by the hook or rod on a forklift.

The width of the two complimentary loops or links 17 is such that, when the core 20 of the roll 21 of paper is centered on the plate 10, the ends of the links 17 will function in cooperation with the rods 14 to provide stops which are arranged roughly 90° from each other so that the end of the core 20 will be centered on the plate 10 and snugly received at the proximal ends of rods 14 and snugly received by the ends of the loops 17. Thus, the end portions of the respective loops 17 and the outer portions of the pins or rods 14 define a circle or circumference approximately equal to the inside diameter of the core 20. The upper flights or bars of the loops or links 17, being radially inwardly of the lower flights or bars of links 17, hold the sling or web 19 so that the core 20 will not shift to any appreciable extent.

In the preferred embodiment of the present invention, the chain link 17 is about 1¾ inches high and about 2¾ inches long. Preferably this link or loop 17 is made from ½ inch diameter rod which is bent to form the continuous loop with straight upper and lower flights or bars. Each rod which is bent to form a loop 17 is of a high test or tensile chain.

The webbing for the strap or sling 20 is preferably a woven or braided flexible fabric, the ends of which are overlapped and stitched. The welds 8 at the proximal ends of the rods 14 as well as the welds 9 for the lower flights of the links 17 are made using L56 electrode wire and are welded using an inert gas containing 98% argon and 2% oxygen.

In use, the sling 19 is passed up through the hollow core 20 so that an upper bight portion of the sling 19 will extend out of the other end of core 20. The plate 10 is then urged against the bottom portion of the core 20 and against the bottom portion of the paper roll 21. The protruding portion of the sling 19 can then be lifted to lift the core 20 and roll 21.

It will be obvious to those skilled in the art that many variations may be made in the embodiment here chosen for the purpose of illustrating the present invention, without departing from the scope thereof as defined by the appended claims.

I claim:

1. A lifting means for a roll of paper received on a cylindrical core, said roll of paper having a lower edge, said core having a hollow interior extending from one end of said core to the other end thereof, the ends of said core being open and communicating with said interior, said lifting means comprising:

(a) a support plate having a flat upper surface;

(b) a pair of spaced strap receiving loops disposed on said support plate, said loops having openings aligned with each other and having bottom portions secured to said plate and upper portions spaced from said bottom portion, said loops being spaced from each other;

(c) a flexible strap extending through the openings of said loops;

(d) the space between said loops being sufficiently small that both of said loops may be received within one end of said cylindrical core;

(e) said flexible strap being sufficiently long that it may extend around said upper portions of said loops and through the openings of said loops and above a portion of the upper surface of said plate and also up through the hollow portion of said core and outwardly of the other end of said core so that a portion of said strap extends externally of said core; and (f) said plate being of sufficient dimensions that it extends beneath a portion of the bottom portion of said paper roll and is seated against said lower edge of said roll of paper when the portion of the strap which extends externally of said core is lifted.

2. The lifting means defined in claim 1 including guide means on said upper surface of said plate and protruding outwardly therefrom for positioning said plate within said one end of said core.

3. The lifting means defined in claim 1 including a pair of opposed upstanding guide pins on said plate, said pins being spaced apart by a distance approximately equal to or slightly smaller than the diameter of said core so that said plate may be guided by said pins against said one end of said core.

4. The lifting means defined in claim 3 wherein said guide pins are inclined toward each other.

5. The lifting means defined in claim 3 wherein said loops are diametrically opposed to each other on said plate and said pins are diametrically opposed to each other on said plate, said pins being circumferentially spaced from said loops, the space between said pins and the space between said loops being such that said loops and said pins will engage the inner periphery of said core when said plate is positioned on said one end of said core.

6. The lifting means defined in claim 1 wherein said loops are each an individual link of chain.

7. The lifting means defined in claim 1 wherein said plate is rectangular in shape, said plate having a central portion which is open.

8. The lifting means defined in claim 1 wherein said strap is formed from a single length of flat flexible material, said strap having end portions which are overlapped, the overlapped end portions being joined together, said loops having straight upper portions against which a flat portion of said strap engage.

9. The lifting means defined in claim 1 wherein said loops have end portions and one of said loops is such a distance from the other of said loops that said end portions of both of said loops engage the interior periphery of said core when said core and roll of paper are received on said plate.

10. The lifting means defined in claim 1 including welds for securing lower portions of said loops to the upper surface of said plate.

11. The lifting means defined in claim 1 wherein said plate is square and has a central portion and defines diagonals which intersect each other at the central portion of said plate and wherein said plate has a square opening in its central portion, the openings of said loops being aligned with each other along one diagonal of said plate.

12. The lifting means defined in claim 11 including upstanding guide means mounted on said plate, said guide means being aligned with each other along the other diagonal of said plate, said loops and said guide means defining a circumference along said plate just sufficient that when said plate is mounted against an end of said core, said loops and said guide means will be adjacent to the inner periphery of said core.

13. The lifting means defined in claim 12 wherein said guide means are upstanding rods which are inclined toward each other.

14. The combination including a roll of paper having an upper edge and lower edge, said roll of paper being received on a cylindrical core, said core having a pair of opposed open ends and a hollow interior extending from one open end of said core to the other open end of said core, the ends of said core respectively terminating adjacent to the edges of said roll of paper, wherein the improvement comprises:

(a) a rigid metal support plate having a flat upper surface for being removeably received on the lower edge of said roll of paper when said plate is disposed in a lifting position adjacent to said lower edge of said roll of paper;

(b) a pair of spaced opposed metal strap receiving loops fixedly mounted by their lower portions to said plate, said loops extending above said upper surface of said plate and having upper portions in a common plane spaced above said upper surface of said plate, said loops defining opposed aligned elongated openings spaced from each other;

(c) a flexible strap having a lower portion passing through said openings and a remaining portion of sufficient length that it will pass through the hollow portion of said core, when said plate is disposed adjacent to said lower edge of said roll of paper and adjacent to one end of said core, and an end portion of said strap protrudes outwardly beyond the other end of said core, a portion of said strap between said loops extending generally in a plane above said flat upper surface of said plate; and (d) the space between said loops being sufficient for both of said loops to be received in the interior of said core when said plate is received against said lower edge of said roll of paper.

* * * * *